US008602326B2

(12) United States Patent
Seitz et al.

(10) Patent No.: US 8,602,326 B2
(45) Date of Patent: Dec. 10, 2013

(54) SPRAY DEVICE HAVING A PARABOLIC FLOW SURFACE

(76) Inventors: David M. Seitz, Riga, MI (US); Roger T. Cedoz, Curtice, OH (US)

( * ) Notice: Subject to any disclaimer, the term of this patent is extended or adjusted under 35 U.S.C. 154(b) by 799 days.

(21) Appl. No.: 11/773,156

(22) Filed: Jul. 3, 2007

(65) Prior Publication Data

US 2009/0008469 A1 Jan. 8, 2009

(51) Int. Cl.

| | |
|---|---|
| ***B05B 3/10*** | (2006.01) |
| ***B05B 5/04*** | (2006.01) |
| ***B05B 5/025*** | (2006.01) |
| ***B05B 5/00*** | (2006.01) |

(52) U.S. Cl.
USPC ..... 239/223; 239/700; 239/703; 239/706; 118/626; 118/627; 118/629

(58) Field of Classification Search
USPC ..... 239/223, 224, 112, 700, 703, 690, 699, 239/706, 707, 708, 591, 701; 285/321; 118/621–629
See application file for complete search history.

(56) References Cited

U.S. PATENT DOCUMENTS

| | | | | |
|---|---|---|---|---|
| 1,880,880 | A | | 10/1932 | Dietsch |
| 1,881,409 | A | | 10/1932 | Le Moon |
| 2,259,011 | A | | 10/1941 | Taylor |
| 2,943,798 | A | | 7/1960 | Rienks |
| 3,000,574 | A | | 9/1961 | Sedlacsik |
| 3,029,030 | A | | 4/1962 | Dey |
| 3,043,521 | A | | 7/1962 | Wampler |
| 3,063,642 | A | | 11/1962 | Point |
| 3,190,564 | A | | 6/1965 | Liedberg |
| 3,224,680 | A | * | 12/1965 | Burnside et al. ..... 239/223 |
| 3,533,561 | A | | 10/1970 | Henderson |
| 3,652,016 | A | | 3/1972 | Cheshire |
| 3,684,174 | A | * | 8/1972 | Bein ..... 239/703 |
| 3,746,253 | A | | 7/1973 | Walberg |
| 3,791,582 | A | | 2/1974 | Mencacci |

(Continued)

FOREIGN PATENT DOCUMENTS

| | | |
|---|---|---|
| EP | 0951941 | 10/1999 |
| EP | 1134026 | 9/2001 |

(Continued)

OTHER PUBLICATIONS http://www.merriam-webster.com/ "Parabola".*

(Continued)

*Primary Examiner* — Darren W Gorman
(74) *Attorney, Agent, or Firm* — Fletcher Yoder, P.C.

(57) ABSTRACT

A rotary atomizer spray coating device, in certain embodiments, has a bell cup with a generally parabolic flow surface. This generally parabolic flow surface provides additional surface area for dehydration of coating fluids, thereby improving color matching as compared to traditional bell cups, for example, by affording capability for higher wet solids content. In addition, the coating fluid accelerates along the generally parabolic flow surface, resulting in the fluid leaving the bell cup at a greater velocity than in traditional bell cups. Furthermore, a splash plate disposed adjacent the bell cup, in certain embodiments, is designed such that fluid accelerates through an annular area between the splash plate and the generally parabolic flow surface. This acceleration may substantially reduce or eliminate low-pressure cavities in which fluid and/or particulate matter may be trapped, resulting in an even application of coating fluid and more effective cleaning of the bell cup as compared with traditional bell cups.

28 Claims, 9 Drawing Sheets

(56) References Cited

U.S. PATENT DOCUMENTS

| | | | | |
|---|---|---|---|---|
| 3,825,188 | A | | 7/1974 | Doering |
| 3,933,133 | A | | 1/1976 | Shekleton |
| 4,227,896 | A | | 10/1980 | Larsson et al. |
| 4,301,822 | A | | 11/1981 | Dingler |
| 4,350,302 | A | | 9/1982 | Gruber et al. |
| 4,350,304 | A | | 9/1982 | Sugiyama et al. |
| 4,360,165 | A | | 11/1982 | Sugiyama et al. |
| 4,361,287 | A | | 11/1982 | Morishita et al. |
| 4,398,672 | A | | 8/1983 | Arnold et al. |
| 4,402,991 | A | | 9/1983 | Meisner |
| 4,405,086 | A | | 9/1983 | Vetter |
| 4,422,577 | A | | 12/1983 | Arnold et al. |
| 4,423,840 | A | | 1/1984 | Coeling |
| 4,430,003 | A | | 2/1984 | Beattie et al. |
| RE31,590 | E | | 5/1984 | Mitsui |
| 4,458,844 | A | | 7/1984 | Mitsui |
| 4,502,634 | A | | 3/1985 | Bals |
| 4,505,430 | A | | 3/1985 | Rodgers et al. |
| 4,512,518 | A | | 4/1985 | Inukai |
| 4,555,058 | A | | 11/1985 | Weinstein et al. |
| 4,582,258 | A | | 4/1986 | Olson |
| D283,832 | S | | 5/1986 | Weinstein et al. |
| 4,643,357 | A | | 2/1987 | Culbertson et al. |
| 4,646,977 | A | | 3/1987 | Iwamura et al. |
| 4,684,064 | A | | 8/1987 | Kwok |
| 4,784,332 | A | | 11/1988 | Takeuchi et al. |
| 4,795,095 | A | | 1/1989 | Shepard |
| 4,819,879 | A | | 4/1989 | Sharpless et al. |
| 4,834,292 | A | | 5/1989 | Dyck |
| 4,838,487 | A | | 6/1989 | Schneider |
| 4,899,936 | A | | 2/1990 | Weinstein |
| 4,911,365 | A | | 3/1990 | Thiel et al. |
| 4,919,333 | A | | 4/1990 | Weinstein |
| 4,919,967 | A | | 4/1990 | Handke et al. |
| 4,927,081 | A | | 5/1990 | Kwok et al. |
| 4,928,883 | A | | 5/1990 | Weinstein et al. |
| 4,936,507 | A | | 6/1990 | Weinstein |
| 4,936,509 | A | | 6/1990 | Weinstein |
| 4,936,510 | A | | 6/1990 | Weinstein |
| 4,943,005 | A | | 7/1990 | Weinstein |
| 4,943,178 | A | | 7/1990 | Weinstein |
| 4,985,283 | A | | 1/1991 | Ogata et al. |
| 4,997,130 | A | | 3/1991 | Weinstein |
| 5,039,019 | A | | 8/1991 | Weinstein et al. |
| 5,072,883 | A | | 12/1991 | Vidusek |
| 5,078,321 | A | | 1/1992 | Davis et al. |
| 5,079,030 | A | | 1/1992 | Tomioka et al. |
| 5,090,361 | A | | 2/1992 | Ishibashi et al. |
| 5,137,215 | A | | 8/1992 | Degli |
| 5,241,938 | A | | 9/1993 | Takagi et al. |
| 5,346,139 | A | | 9/1994 | Davis et al. |
| 5,353,995 | A | | 10/1994 | Chabert |
| 5,397,063 | A | | 3/1995 | Weinstein |
| 5,474,236 | A | | 12/1995 | Davis et al. |
| 5,531,033 | A | | 7/1996 | Smith et al. |
| 5,620,750 | A | | 4/1997 | Minoura et al. |
| 5,683,032 | A | | 11/1997 | Braslaw et al. |
| 5,707,009 | A | | 1/1998 | Schneider |
| 5,727,735 | A | | 3/1998 | Baumann et al. |
| 5,803,372 | A | | 9/1998 | Weinstein et al. |
| 5,853,126 | A | | 12/1998 | Alexander |
| 5,865,380 | A | * | 2/1999 | Kazama et al. ..... 239/704 |
| 5,894,993 | A | | 4/1999 | Takayama et al. |
| 5,897,060 | A | * | 4/1999 | Kon et al. ..... 239/223 |
| 5,909,849 | A | | 6/1999 | Yamasaki et al. |
| 5,934,574 | A | | 8/1999 | Van Der Steur |
| 5,941,457 | A | * | 8/1999 | Nakazono et al. ..... 239/223 |
| 5,947,377 | A | | 9/1999 | Hansinger et al. |
| 5,975,432 | A | | 11/1999 | Han |
| 6,050,499 | A | * | 4/2000 | Takayama et al. ..... 239/112 |
| 6,076,751 | A | | 6/2000 | Austin et al. |
| 6,189,804 | B1 | | 2/2001 | Vetter et al. |
| 6,328,224 | B1 | * | 12/2001 | Alexander ..... 239/223 |
| 6,341,734 | B1 | | 1/2002 | Van Der Steur |
| 6,360,962 | B2 | | 3/2002 | Vetter et al. |
| 6,557,781 | B2 | * | 5/2003 | Kon ..... 239/224 |
| 6,578,779 | B2 | | 6/2003 | Dion |
| 6,623,561 | B2 | | 9/2003 | Vetter et al. |
| 6,793,150 | B2 | * | 9/2004 | Schaupp et al. ..... 239/224 |
| 6,857,581 | B2 | | 2/2005 | Steiger |
| 6,896,211 | B2 | * | 5/2005 | Seitz ..... 239/700 |
| 7,017,835 | B2 | | 3/2006 | Vetter et al. |
| 7,128,277 | B2 | * | 10/2006 | Schaupp ..... 239/3 |
| 2006/0138250 | A1 | | 6/2006 | Vetter et al. |

FOREIGN PATENT DOCUMENTS

| | | | |
|---|---|---|---|
| EP | 1250960 | | 10/2002 |
| JP | 57045358 | | 3/1982 |
| JP | 633197076 | | 12/1988 |
| JP | 405099100 | A | 4/1993 |
| JP | 2000000496 | | 1/2000 |

OTHER PUBLICATIONS

Corbeels et al.; "Atomization Characteristics of a High-Speed Rotary-Bell Paint Applicator;" School of Mechanical Engineering, Purdue University, West Lafayette, IN, U.S.A.; ICLASS/91, Gaithersburg, MD, U.S.A. Jul. 1991; p. 8; pp. 121-128.

Elmoursi et al.; "Droplet and Flake Size Distribution in the Electrostatic Spraying of Metallic Paint;" SAE Technical Paper Series; International Congress and Exposition, Detroit, Michigan, Feb. 27-Mar. 3, 1989; pp. 1-7.

Huang et al.; "Simulation of Spray Transport from Rotary Cup Atomizer using KIVA-3V;" Department of Mechanical Engineering, Wayne State University, Detroit, Michigan 48202, USA; 6 pages, (2000).

* cited by examiner

SPRAY DEVICE HAVING A PARABOLIC FLOW SURFACE

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Spray coating devices, often described as spray guns, are used to spray a coating onto a wide variety of work products. In addition, there are a variety of different types of spray coating devices. Some spray coating devices are manually operated, while others are operated automatically. One example of a spray coating device is a rotary atomizer. Rotary atomizers utilize a spinning disc or bell to atomize a coating material, such as paint, by centrifugal action. An electrostatic charge may be imparted to the atomized paint particles with a small amount of shaping air to project the particles forward toward the object that is being coated. Rotary atomizers may generally have a splash plate to direct fluids toward the surface of the bell, where the fluid is dehydrated as it flows to the edge of the bell. In some cases, inadequate dehydration may cause variations in the spray coating color. In addition, fluid and/or particulate matter may become lodged between the splash plate and the bell cup, causing irregularities in the spray coating and difficulty in cleaning the spray device.

BRIEF DESCRIPTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

A spray coating device, in one embodiment, includes a bell cup having a generally parabolic flow surface. A spray coating system, in another embodiment, includes a bell cup having a central opening, an outer edge downstream from the central opening, and a flow surface between the central opening and the outer edge. The flow surface has a flow angle relative to a central axis of the bell cup, and the flow angle decreases in a flow path along the flow surface. A method for dispensing a spray coat, in another embodiment, includes flowing fluid from a central opening in a bell cup to an outer edge of the bell cup at least partially along a generally parabolic path.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

A rotary atomizer spray coating device, in certain embodiments, has a bell cup with a curved flow surface, such as a generally parabolic flow surface, in a flow path for fluid flowing downstream to create a spray. In other words, an angle tangent to the flow surface progressive changes along the flow path, for example, in a completely continuous manner, in small steps, or with compounded curves. The curved flow surface, e.g., generally parabolic or with curves approximating a parabolic curve, is contrastingly different from a conical flow surface in terms of function, way, and result associated with the fluid flow, spray characteristics, color matching, and cleaning, among other things. For example, the generally parabolic flow surface provides additional surface area for dehydration of coating fluids, thereby improving color matching as compared to traditional bell cups, for example, by affording capability for higher wet solids content. In addition, the coating fluid accelerates along the generally parabolic flow surface, resulting in the fluid leaving the bell cup at a greater velocity than in traditional bell cups. Furthermore, a splash plate disposed adjacent the bell cup, in certain embodiments, is designed such that fluid accelerates through an annular area between the splash plate and the generally parabolic flow surface. This acceleration may substantially reduce or eliminate low-pressure cavities in which fluid and/or particulate matter may be trapped, resulting in an even application of coating fluid and more effective cleaning of the bell cup as compared with traditional bell cups.

Figure 1:
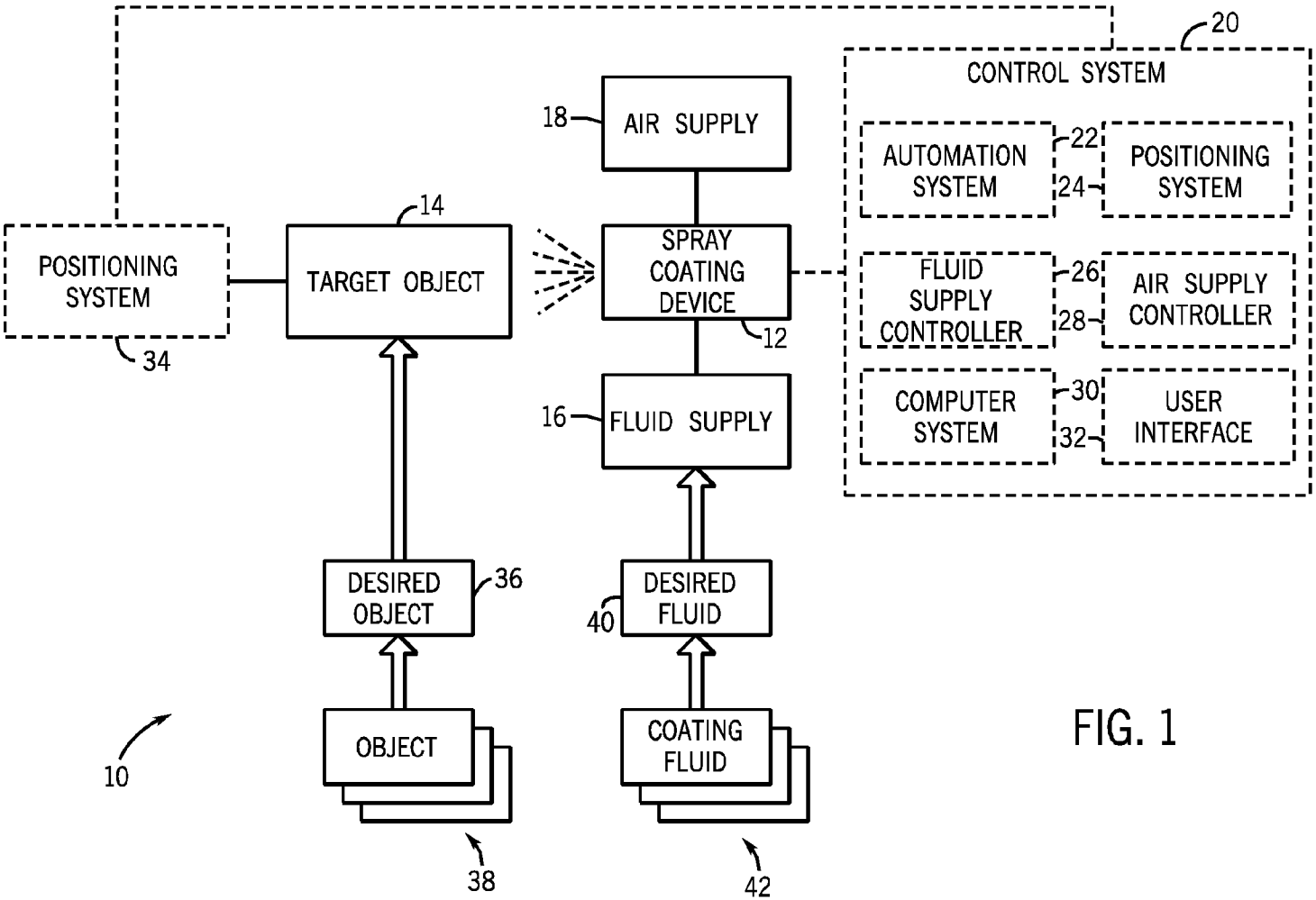
FIG. 1 is a diagram illustrating an embodiment of a spray coating system having a spray coating device with a parabolic flow surface.

FIG. 1 is a flow chart illustrating an exemplary spray coating system 10, which generally includes a spray coating device 12 having a curved flow surface (e.g., a generally parabolic flow surface) for applying a desired coating to a target object 14. Again, as mentioned above and discussed in further detail below, the curved flow surface of the spray coating device 12 provides significant advantages over existing conical flow surfaces. For example, the function of the curved flow surface may include increasing dehydration of the fluid, accelerating the fluid flow as it flows downstream, and progressively increasing force on the fluid as it flows downstream. The increased dehydration is provided by the increased surface area attributed to the curved geometry as compared to a conical geometry. In addition, the thickness of the sheet of fluid flowing across the curved flow surface decreases from the center of the surface outward. The accelerated fluid flow is provided by the progressively changing angle of the fluid flow attributed to the curved geometry as compared to a conical geometry. The progressively increasing force is also provided by the progressively changing angle of the fluid flow attributed to the curved geometry as compared to a conical geometry. The thickness of the fluid sheet as it leaves the edge of the curved flow surface may be greater than that of a traditional conical bell cup, however the greater force and/or greater acceleration of the fluid flowing along and leaving the bell cup provides improved color matching, improved atomization, and reduced clogging (e.g., the system is cleaner) as compared to traditional conical bell cups.

The spray coating device 12 may be coupled to a variety of supply and control systems, such as a fluid supply 16, an air supply 18, and a control system 20. The control system 20 facilitates control of the fluid and air supplies 16 and 18 and ensures that the spray coating device 12 provides an acceptable quality spray coating on the target object 14. For example, the control system 20 may include an automation system 22, a positioning system 24, a fluid supply controller 26, an air supply controller 28, a computer system 30, and a user interface 32. The control system 20 also may be coupled to a positioning system 34, which facilitates movement of the target object 14 relative to the spray coating device 12. Accordingly, the spray coating system 10 may provide synchronous computer control of coating fluid rate, air flow rate, and spray pattern. Moreover, the positioning system 34 may include a robotic arm controlled by the control system 20, such that the spray coating device 12 covers the entire surface of the target object 14 in a uniform and efficient manner. In one embodiment, the target object 14 may be grounded to attract charged coating particles from the spray coating device 12.

The spray coating system 10 of FIG. 1 is applicable to a wide variety of applications, fluids, target objects, and types/configurations of the spray coating device 12. For example, a user may select a desired object 36 from a variety of different objects 38, such as different material and product types. The user also may select a desired fluid 40 from a plurality of different coating fluids 42, which may include different coating types, colors, textures, and characteristics for a variety of materials such as metal and wood. As discussed in further detail below, the spray coating device 12 also may comprise a variety of different components and spray formation mechanisms to accommodate the target object 14 and fluid supply 16 selected by the user. For example, the spray coating device 12 may comprise an air atomizer, a rotary atomizer, an electrostatic atomizer, or any other suitable spray formation mechanism.

Figure 2:
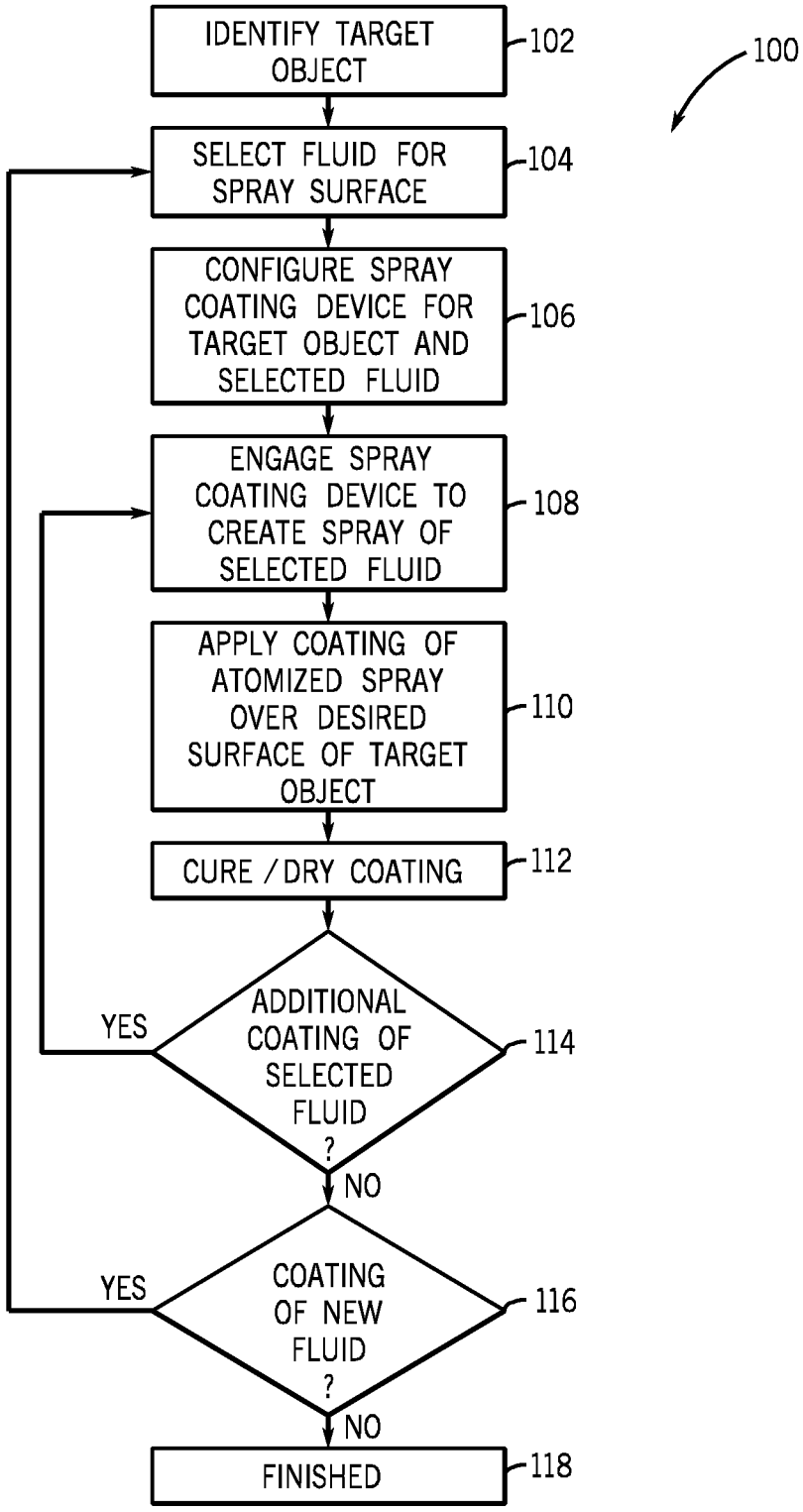
FIG. 2 is a flow chart illustrating an embodiment of a spray coating process using a spray coating device having a parabolic flow surface.

The spray coating system 10 may be utilized according to an exemplary process 100 for applying a desired spray coating to the target object 14, as illustrated in FIG. 2. The process 100 begins by identifying the target object 14 for application of the desired fluid (block 102). The process 100 then proceeds by selecting the desired fluid 40 for application to a spray surface of the target object 14 (block 104). The spray coating device 12 may be configured for the identified target object 14 and selected fluid 40 (block 106). As the spray coating device 12 is engaged, an atomized spray of the selected fluid 40 is created (block 108). The spray coating device 12 may then apply a coating of the atomized spray to the desired surface of the target object 14 (block 110). The applied coating is then cured and/or dried (block 112). If an additional coating of the selected fluid 40 is requested at a query block 114, then the process 100 proceeds through blocks 108, 110, and 112 to provide another coating of the selected fluid 40. If an additional coating of the selected fluid is not requested at query block 114, then the process 100 proceeds to a query block 116 to determine whether a coating of a new fluid is needed. If a coating of a new fluid is requested at query block 116, then the process 100 proceeds through blocks 104, 106, 108, 110, 112, and 114 using a new selected fluid for the spray coating. If a coating of a new fluid is not requested at query block 116, then the process 100 is finished (block 118).

Figure 3:
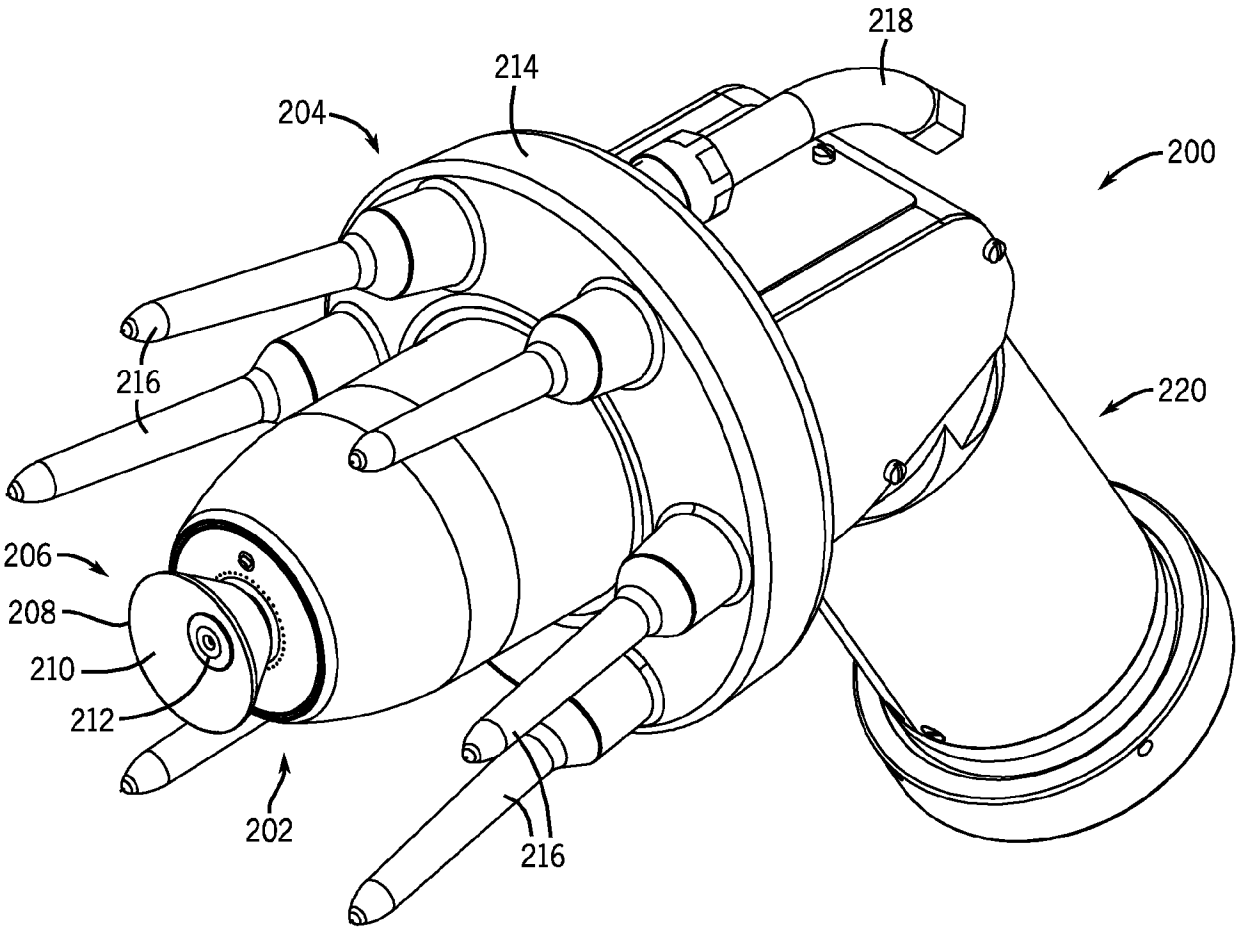
FIG. 3 is a perspective view of an embodiment of a spray coating device having a parabolic flow surface.
Figure 5:
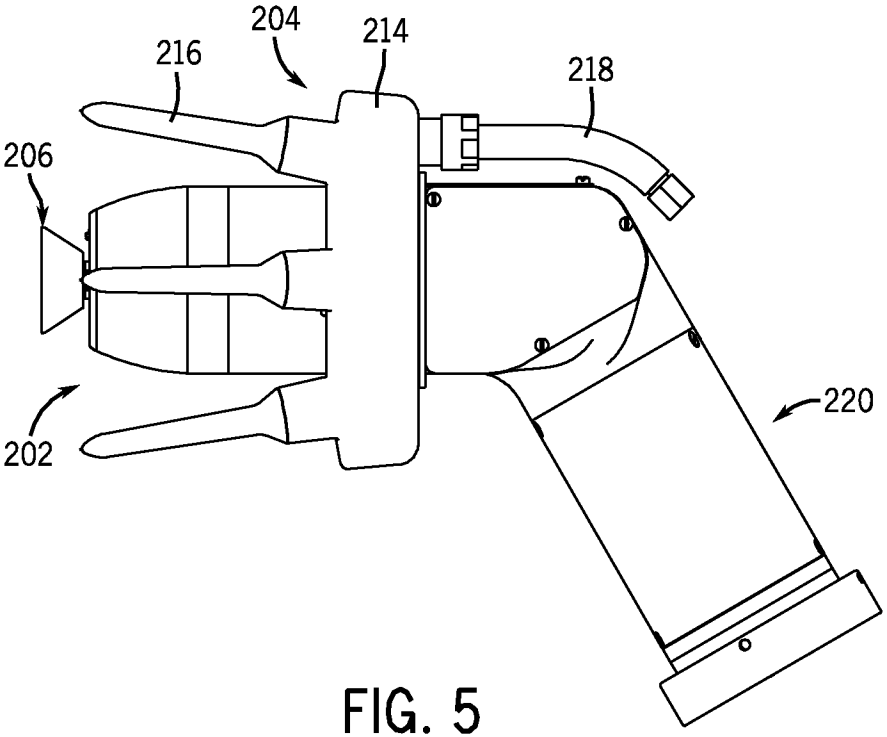
FIG. 5 is a side view of an embodiment of the spray coating device of FIG. 3.
Figure 4:
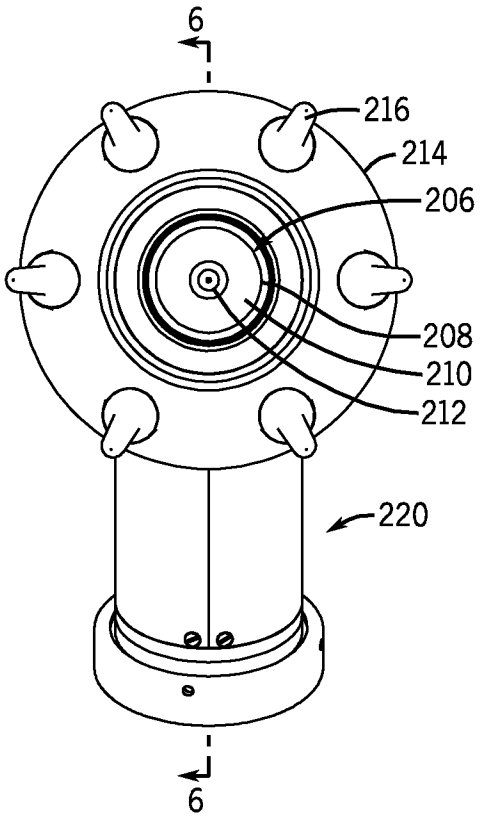
FIG. 4 is a front view of an embodiment of the spray coating device of FIG. 3.

A perspective view of an exemplary embodiment of a spray device 200 for use in the system 10 and process 100 is illustrated in FIG. 3. The spray device 200 includes a rotary atomizer 202 and an electrostatic charge generator 204. The rotary atomizer 202 includes at its front a bell cup 206 having an atomizing edge 208 and a flow surface 210. As mentioned above and discussed in detail below, the flow surface 210 advantageously includes a curved flow surface, such as a generally parabolic flow surface, as opposed to a substantially or entirely conical flow surface. A splash plate 212 is disposed within the bell cup 206. The electrostatic charge generator 204 includes a high voltage ring 214, high voltage electrodes 216, and a connector 218 for connection to a power source. A neck 220 of the spray device 200 includes at its distal end air and fluid inlet tubes and a high voltage cable inlet. FIGS. 4 and 5 are front and side views, respectively, of an embodiment of the spray device 200 of FIG. 3.

Figure 6:
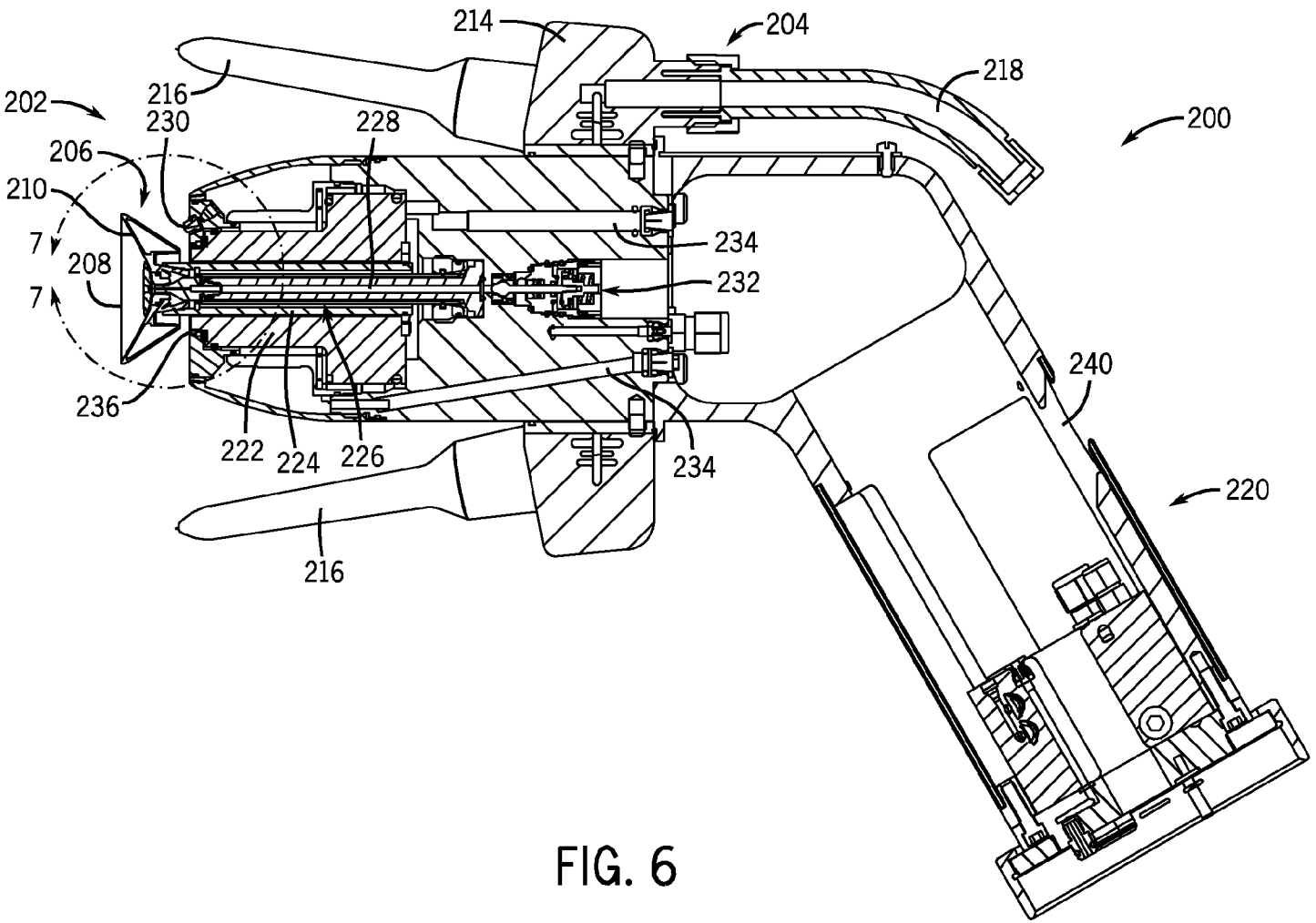
FIG. 6 is a cross-sectional view of an embodiment of the spray coating device of FIG. 4 taken along line 6-6.

FIG. 6 is a cross-sectional view of an embodiment of the spray device 200 taken along line 6-6 of FIG. 4. The rotary atomizer 202 includes an atomizer spindle 222 and a spindle shaft 224. An air turbine rotates the spindle shaft 224 within the spindle 222. The bell cup 206 is coupled to a proximal end of the spindle shaft 224 such that rotation of the spindle shaft 224 also rotates the bell cup 206. When fluid enters the rotating bell cup 206, the fluid travels along the flow surface 210 (e.g., curved, parabolic, or substantially continuously changing) and is atomized into fluid particles as it leaves the atomizing edge 208.

A fluid tube 226 is disposed within the spindle shaft 224 for supplying fluids, such as the desired coating fluid 40, to the bell cup 206. The illustrated fluid tube 226 is not coupled to the spindle shaft 224 and does not rotate with respect to the spray device 200. One or more fluid passageways 228 may be disposed within the fluid tube 226 and may extend to one or more fluid supplies. In some instances, it may be desirable to clean the bell cup 206 without purging the system. Accordingly, the fluid passageways 226 may include separate passageways for the coating fluid 40 and a solvent. In addition, a solvent nozzle 230 is located adjacent to the bell cup 206 and is configured to direct a spray of cleaning solvent to the exterior of the bell cup 206. A fluid valve 232 is disposed within the coating fluid passageway 228 and is configured to selectively enable flow of the coating fluid 40 when air is supplied to the air turbine. That is, the valve 232 opens when rotation of the spindle shaft 224 and the bell cup 206 is activated.

Air is supplied to the turbine via one or more air passageways 234. The air passageways 234 also supply air to shaping air jets 236. The shaping air jets 236 are configured to direct the fluid particles toward the target object 14 as the particles leave the atomizing edge 208 of the bell cup 206. In addition, the high voltage electrodes 216 are configured to generate a strong electrostatic field around the bell cup 206. This electrostatic field charges the atomized fluid particles such that the particles are attracted to the grounded target object 14. The high voltage electrodes 216 are energized via the high voltage ring 214. The connector 218 is configured to couple the high voltage ring 214 to a high voltage cable. The high voltage cable may exit the neck 220 at an opening 240 to couple with the connector 218.

Figure 7:
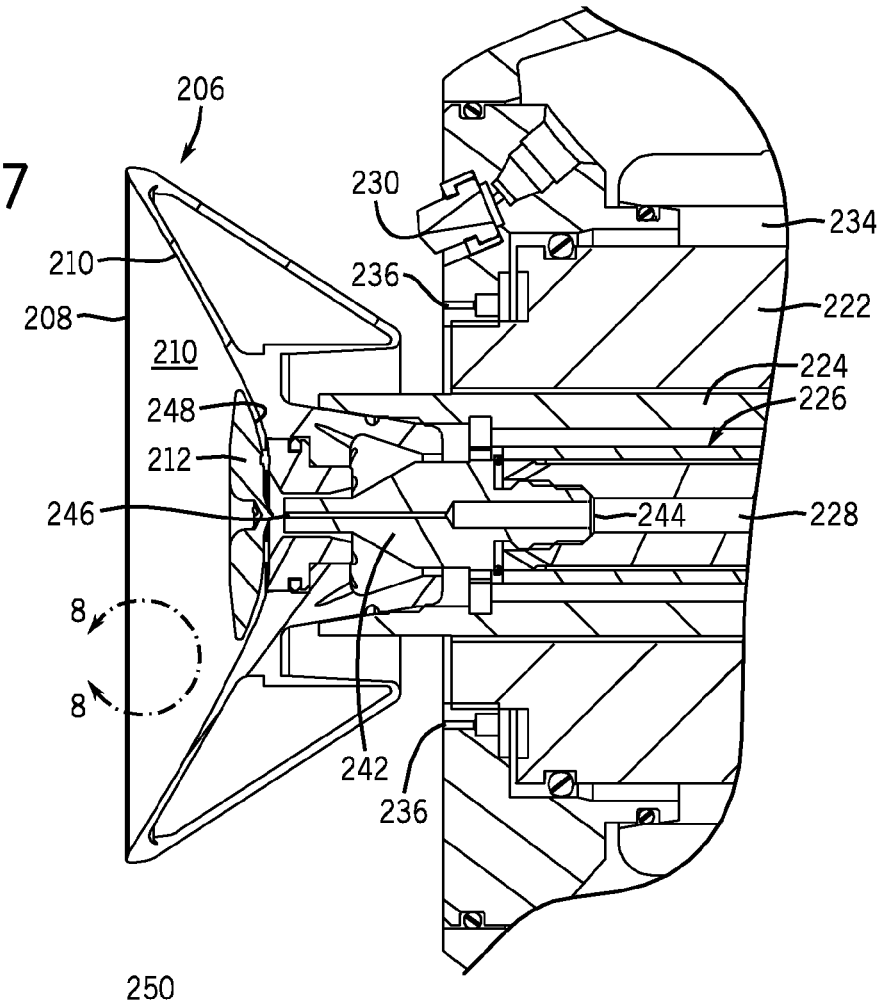
FIG. 7 is a partial cross-sectional view of an embodiment of the spray coating device of FIG. 6 taken along line 7-7.

FIG. 7 is a close-up cross-sectional view of an embodiment of the spray coating device 200 taken along line 7-7 of FIG. 6. A fluid tip 242 is connected to a proximal end of the fluid tube 226. One or more fluid inlets 244 in the fluid tip 242 are connected to the one or more fluid passageways 228 in the fluid tube 226. Fluid exits the tip 242 at a fluid outlet 246 and impacts a rear surface 248 of the splash plate 212. The rear surface 248 of the splash plate 212 directs the fluid radially outward toward the flow surface 210. As the bell cup 206 rotates, the fluid travels along the flow surface 210 to the atomizing edge 208. As discussed further below, the flow path between the rear surface 248 of the splash plate 212 and the flow surface 210 (e.g., curved, parabolic, or substantially continuously changing) may converge the fluid flow that is flowing toward the edge 208, thereby reducing the potential for low pressure zones, clogging, and so forth. Thus, the converging flow may ensure that the spray coating device 200 remains clean, thereby reducing downtime for cleaning or repair due to debris buildup.

Figure 8:
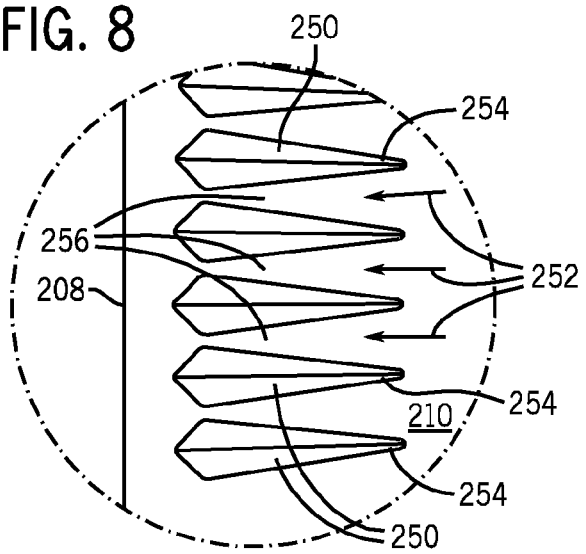
FIG. 8 is a partial view of a serrated edge of an embodiment of the spray coating device of FIG. 7 taken along line 8-8.

In one embodiment, the atomizing edge 208 may include serrations 250, as illustrated in FIG. 8. As the bell cup 206 rotates, fluid travels along the flow surface 210 generally in the direction of arrows 252. As the fluid reaches a tapered end 254 of the serrations 250, separate fluid paths 256 are formed between the serrations 250. The serrations 250 may increase in width and height away from the tapered ends 254, decreasing the width of the fluid paths 256. As a result of the serrations 250, the fluid may tend to leave the edge 208 of the bell cup 206 traveling generally in a direction along the fluid paths 256. Other structures may also be utilized, such as, for example, ridges or grooves. Moreover, as mentioned above, the curved geometry (e.g., generally parabolic) of the flow surface 210 may accelerate the fluid flow and increase the force applied to the fluid in the path toward the edge 208. As a result, the increased acceleration and force on the fluid flow may improve the effectiveness of the serrations 250, which then improves atomization, color matching, and so forth.

Figure 9:
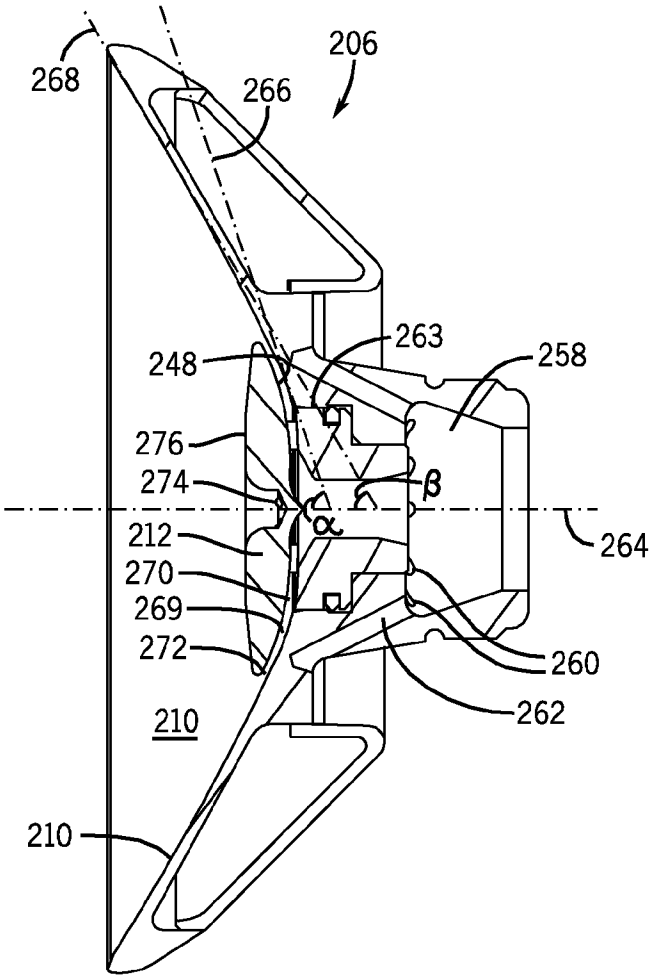
FIG. 9 is a cross-sectional view of an embodiment of a bell cup having a parabolic flow surface for use with a spray coating device.

Referring now to FIG. 9, if the bell cup 206 does not have a sufficient rotational velocity, fluid may enter the bell cup 206 at a greater rate than it can be dispersed. Accordingly, there is provided a flow cavity 258 having holes 260 which are in fluid communication with the exterior of the bell cup 206 via channels 262. Excess fluid exiting the fluid outlet 246 may travel to the flow cavity 258 and out of the bell cup 206 rather than backing up in the fluid tube 226.

In the exemplary embodiment illustrated in FIG. 9, the flow surface 210 of the bell cup 206 extends from a central opening 263 to the atomizing edge 208. The illustrated flow surface 210 has a curved shape, which is a generally parabolic shape. That is, the flow surface 210 may be defined by a parabolic curve rotated about a center axis 264. However, a variety of other curved surfaces also may be used for the flow surface 210 of the bell cup 206. It should be noted that the flow surface 210 is at least partially, substantially, or entirely curved, but is not substantially or entirely conical. For example, the flow surface 210 may be 10, 20, 30, 40, 50, 60, 70, 80, 90, 95, or 100 percent curved in a path extending between the central opening 263 and the edge 208. The curved geometry, e.g., parabolic, may be defined as a single continuous curve, a compounded curve, a series of curves in steps one after another (e.g., stepwise curve), and so forth. For example, each step may be less than 1, 2, 3, 4, 5, 6, 7, 8, 9, 10, or possibly a greater percent of the distance between the opening 263 and the edge 208.

In certain embodiments, an angle of the flow surface 210 relative to the central axis 264 decreases progressively from the center of the bell cup 206 to the atomizing edge 208. This angle decrease can be seen in angles $\alpha$ and $\beta$, defined by lines 266 and 268, respectively, with relation to the center axis 264. The line 266 is tangential to the flow surface 210 near the splash plate 212, and the line 268 is tangential to the flow surface 210 near the atomizing edge 208. The curved geometry (e.g., parabolic) of the flow surface 210 provides a greater surface area as compared to traditional bell cups (e.g., conical) for a given bell cup diameter. This improved surface area provides additional dehydration surface for color matching of waterborne coatings by affording capability for higher wet solids content. In addition, the parabolic flow surface 210 results in increasing force on the fluid as it travels to the atomizing edge 208. This increasing force enables the fluid to leave the atomizing edge 208 at a greater velocity than in traditional bell cups. In addition, in bell cups with serrations 250 at or near the atomizing edge 208, the increasing force enables the fluid to flow through the serrations 250 at a greater velocity. The curved flow surface 210 may also result in a thicker sheet of coating at the atomizing edge 208, therefore the curve of the parabola may be determined by balancing the desired sheet thickness against dehydration and fluid velocity requirements. The parabolic flow surface 210 may be manufactured in a stepwise manner such that each step is angled in relation to the previous step. That is, the flow surface 210 may be a number of stepwise surfaces having variably changing angles with respect to the center axis 264.

In addition, the splash plate 212 and bell cup 206 are designed such that there is a converging annular passageway 269 between the rear surface 248 and the flow surface 210. The convergence of the fluid flow may be a constant rate of convergence or it may be an increasing rate of convergence in various embodiments of the spray coating device. As illustrated, a distance 270 near the center axis 264 between the rear surface 248 and the flow surface 210 is greater than a distance 272 away from the center axis 264 between the rear surface 248 and the flow surface 210. This convergence results in an accelerating fluid flow through the annular passageway. The acceleration may be a constant rate of acceleration or it may be an increasing rate of acceleration. In addition, in the illustrated embodiment, there are no flat sections on either the flow surface 210 or the rear surface 248, such that there are no low-pressure cavities in which fluid and/or particulate matter may be trapped. As a result, the coating fluid may be applied at a generally even velocity, and the bell cup 206 may be cleaned more effectively than a traditional bell cup. The splash plate 212 further includes small holes 274 through which fluid may flow. A small amount of fluid may seep through the holes 274 to wet a front surface 276 of the splash plate 212 so that specks of coating fluid do not dry on the splash plate 212 and contaminate the applied coating.

Figure 10:
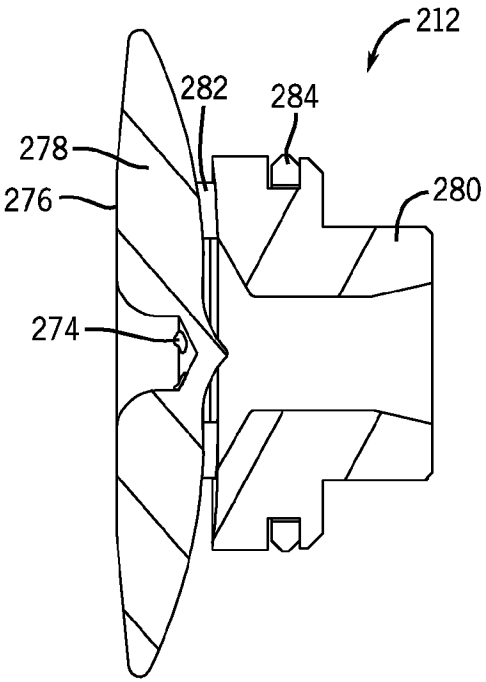
FIG. 10 is a cross-sectional view of a splash plate for use with a spray coating device.

A more detailed view of the splash plate 212 is illustrated in FIG. 10. The splash plate 212 includes two sections, a disc section 278 and an insert section 280. The sections 278 and 280 are held together by connectors 282. The connectors 282 may include, for example, pins or screws. The insert section 280 is configured to be inserted into the central opening 263 in the bell cup 206. A locking ring 284 secures the splash plate 212 to the bell cup 206.

Figure 11:
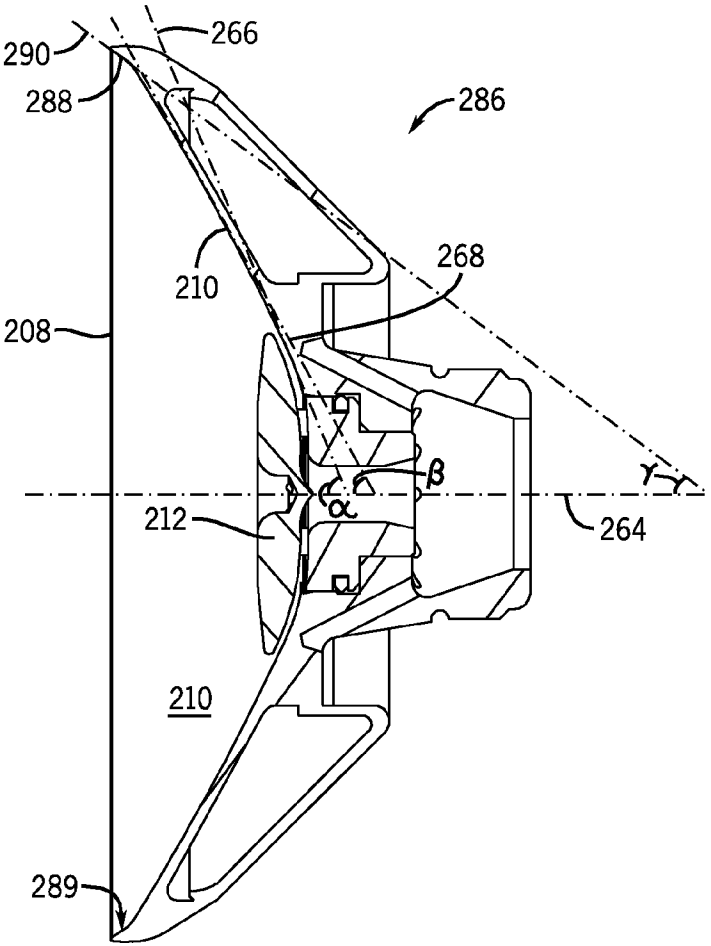

A similar embodiment of the bell cup is illustrated in FIG. 11. In a bell cup 286, the generally parabolic flow surface 210 extends to a flip edge 288 which extends to the atomizing edge 208. A junction region 289 connects the flow surface 210 to the flip edge 288. An angle $\gamma$ is defined by a line 290 tangential to the flip edge 288 and the central axis 264. As can be seen in FIG. 11, the angle $\gamma$ is significantly smaller than the angle $\beta$. In addition, the difference between the angles $\beta$ and $\gamma$ is much larger than the difference between the angles $\alpha$ and $\beta$. This is due to a greater curvature in the junction region 289 than in the flow surface 210. The flip edge 288 may have a constant angle relative to the center axis 264 or may have a progressively decreasing angle similar to the flow surface 210. As fluid reaches the junction region 289, the increased curvature accelerates the fluid at a greater rate as compared to the flow surface 210. Accordingly, fluid may leave the atomizing edge 208 with a greater velocity when the flip edge 288 is present, as in the bell cup 286, than when the flip edge is not present, as in the bell cup 206 of FIG. 9.

Figure 12:
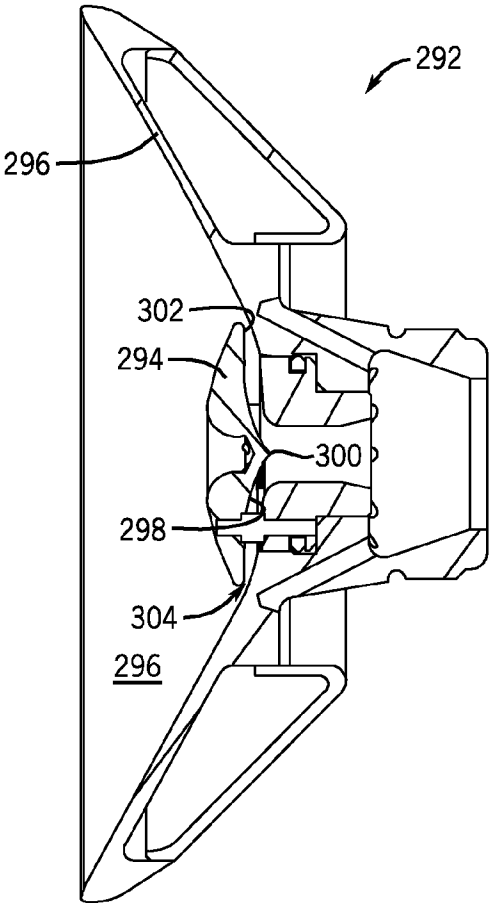
FIGS. 11-13 are cross-sectional views of embodiments of bell cups for use with various spray coating devices.
Figure 13:
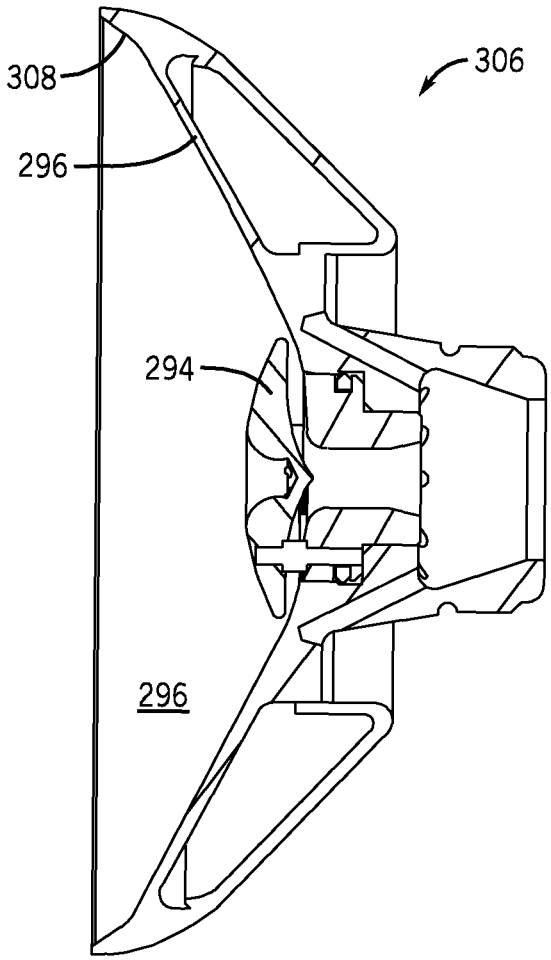

FIGS. 12 and 13 illustrate alternative embodiments of the bell cup and splash plate. A cross-sectional view of a bell cup 292 and a splash plate 294 are illustrated in FIG. 12. The bell cup 292 has a generally parabolic flow surface 296. A rear surface 298 of the splash plate 294 has a generally concave shape from a center point 300 to an edge 302. As with the embodiment illustrated in FIG. 9, the splash plate 294 and the bell cup 292 are configured such that the rear surface 298 and the flow surface 296 converge in the flow path away from the center point 300 of the splash plate 294. In addition, a distance 304 between the edge 302 of the splash plate 294 and the flow surface 296 is greater than the distance 272 in FIG. 9, allowing for a greater flow rate of fluid. In a similar embodiment of the bell cup, illustrated in FIG. 13, a bell cup 306 has a flip edge 308.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A spray coating device, comprising:

a bell cup having a parabolic flow surface defined by a variable angle relative to a central axis of the bell cup, wherein the variable angle progressively changes in a downstream direction along the central axis, wherein the parabolic flow surface comprises a plurality of stepwise surfaces having variably changing angles with respect to the central axis of the bell cup, and each stepwise surface is less than 10 percent of a distance between a central opening and an outer edge of the bell cup; and a flip edge between the parabolic flow surface and the outer edge of the bell cup, wherein the flip edge has an angle discontinuous from the parabolic flow surface, and the parabolic flow surface is at least 90 percent of a flow path from the central opening to the outer edge of the bell cup.

2. The device of claim 1, wherein the parabolic flow surface extends directly from the central opening directly to the flip edge of the bell cup.

3. The device of claim 1, comprising a rotary atomizer having the bell cup.

4. The device of claim 1, comprising a splash plate disposed inside the bell cup, wherein the parabolic flow surface faces a rear surface of the splash plate, and the parabolic flow surface extends in the downstream direction beyond a front surface of the splash plate.

5. The device of claim 4, wherein the rear surface of the splash plate and the parabolic flow surface define a converging annular liquid passageway that converges in the downstream direction.

6. The device of claim 4, wherein the rear surface of the splash plate and the bell cup do not comprise flat surfaces in a space between the splash plate and the bell cup.

7. The device of claim 1, wherein the parabolic flow surface comprises an annular surface defined by a revolution of a parabolic curve about the central axis of the bell cup.

8. The device of claim 1, wherein the bell cup does not comprise any conical flow surface between the central opening and the flip edge of the bell cup.

9. The device of claim 1, wherein the variable angle progressively decreases in the downstream direction along the central axis from the central opening to the flip edge of the bell cup.

10. A spray coating system, comprising:

a bell cup, comprising:

a central opening;

a circular outer edge downstream from the central opening;

a non-conical flow surface between the central opening and the circular outer edge, wherein the non-conical flow surface has a variable flow angle relative to a central axis of the bell cup, the variable flow angle progressively decreases in a downstream flow path along the non-conical flow surface to a downstream end portion having a flip edge between the circular outer edge and the non-conical flow surface, the flip edge has an angle discontinuous from the non-conical flow surface, and the non-conical flow surface is at least 90 percent of the downstream flow path from the central opening to the circular outer edge of the bell cup; and a splash plate disposed inside the bell cup, wherein the non-conical flow surface having the variable flow angle faces a rear surface of the splash plate, the non-conical flow surface extends along the downstream flow path beyond a front surface of the splash plate, the splash plate and the non-conical flow surface define a converging annular liquid passageway that converges in the downstream flow path, the bell cup curves in the downstream flow path along the non-conical flow surface between the central opening and the circular outer edge, and the bell cup does not comprise any flat surface between the central opening and the circular outer edge.

11. The system of claim 10, wherein the non-conical flow surface is a parabolic flow surface, the parabolic flow surface faces the rear surface of the splash plate, the parabolic flow surface extends along the downstream flow path beyond the front surface of the splash plate, and the splash plate and the parabolic flow surface define the converging annular liquid passageway that converges in the downstream flow path.

12. The system of claim 11, wherein the parabolic flow surface is at least 95 percent of the downstream flow path from the central opening to the circular outer edge of the bell cup.

13. The system of claim 10, wherein the variable flow angle continuously progressively decreases in the downstream flow path along the non-conical flow surface directly from the central opening directly to the flip edge.

14. The system of claim 10, comprising a rotary atomizer having the bell cup, and an electrostatic charge generator coupled to the bell cup.

15. The system of claim 10, wherein the variable flow angle decreases at a greater rate in a junction region between the flip edge and the non-conical flow surface than along the non-conical flow surface.

16. A method for dispensing a spray coat, comprising:

parabolically flowing a liquid along a parabolic flow surface of a bell cup between a central opening and a circular outer edge of the bell cup, wherein the parabolic flow surface is defined by a variable angle relative to a central axis of the bell cup, the variable angle progressively decreases in a downstream direction along the central axis, the bell cup comprising a flip edge between the parabolic flow surface and the circular outer edge of the bell cup, the flip edge has an angle discontinuous from the parabolic flow surface, and the parabolic flow surface is at least 90 percent of a flow path from the central opening to the circular outer edge of the bell cup.

17. The method of claim 16, wherein parabolically flowing comprises progressively changing a liquid flow rate along the parabolic flow surface directly from the central opening directly to the flip edge due at least in part to the variable angle that progressively decreases in the downstream direction.

18. The method of claim 16, comprising accelerating the liquid through a converging annular passageway defined by the parabolic flow surface of the bell cup and a splash plate disposed inside the bell cup.

19. The device of claim 1, wherein the parabolic flow surface extends directly to the flip edge of the bell cup.

20. The method of claim 16, wherein the parabolic flow surface extends directly to the flip edge of the bell cup.

21. The device of claim 1, wherein the parabolic flow surface extends directly from the central opening of the bell cup.

22. The device of claim 1, wherein each stepwise surface is less than 2 percent of the distance between the central opening and the flip edge of the bell cup.

23. The system of claim 11, wherein the parabolic flow surface extends directly from the central opening of the bell cup.

24. The system of claim 11, wherein the parabolic flow surface extends directly to the flip edge of the bell cup.

25. The method of claim 16, wherein the parabolic flow surface is at least 95 percent of the flow path from the central opening to the circular outer edge of the bell cup.

26. A spray coating device, comprising:

a bell cup having a parabolic flow surface defined by a first variable angle relative to a central axis of the bell cup, wherein the first variable angle progressively changes in a downstream direction along the central axis;

a splash plate disposed inside the bell cup, wherein the parabolic flow surface faces a rear surface of the splash plate, the parabolic flow surface extends in the downstream direction beyond a front surface of the splash plate, and the rear surface of the splash plate and the bell cup do not comprise flat surfaces in a space between the splash plate and the bell cup; and a flip edge between the parabolic flow surface and an outer edge of the bell cup, wherein the flip edge has an angle discontinuous from the parabolic flow surface, and the parabolic flow surface is at least 90 percent of a flow path from a central opening to an outer edge of the bell cup.

27. A spray coating device, comprising a bell cup having a parabolic flow surface defined by a variable angle relative to a central axis of the bell cup, wherein the variable angle progressively changes in a downstream direction along the central axis, the bell cup comprises a flip edge between the parabolic flow surface and an outer edge of the bell cup, the flip edge has an angle discontinuous from the parabolic flow surface, and the parabolic flow surface is at least 90 percent of a flow path from a central opening to the outer edge of the bell cup.

28. The device of claim 27, wherein the parabolic flow surface is at least 95 percent of the flow path between the central opening and the outer edge of the bell cup, and the flip edge is defined by a second variable angle relative to the central axis of the bell cup, wherein the second variable angle is different than the first variable angle.

* * * * *